US011221159B2

(12) United States Patent
Lee et al.

(10) Patent No.: US 11,221,159 B2
(45) Date of Patent: Jan. 11, 2022

(54) METHOD FOR CONTROLLING A CEILING TYPE AIR CONDITIONER

(71) Applicant: LG ELECTRONICS INC, Seoul (KR)

(72) Inventors: Juyoun Lee, Seoul (KR); Soojin Kang, Seoul (KR); Jusu Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 386 days.

(21) Appl. No.: 16/391,847

(22) Filed: Apr. 23, 2019

(65) Prior Publication Data

US 2019/0353386 A1 Nov. 21, 2019

(30) Foreign Application Priority Data

May 15, 2018 (KR) ..... 10-2018-0055566

(51) Int. Cl.
*F24F 11/79* (2018.01)
*F24F 1/0014* (2019.01)
(Continued)

(52) U.S. Cl.
CPC ..... *F24F 11/79* (2018.01); *F24F 1/0014* (2013.01); *F24F 1/0047* (2019.02); *F24F 2110/10* (2018.01)

(58) Field of Classification Search
CPC ..... F24F 11/79; F24F 1/0007; F24F 1/0047; F24F 1/0014; F24F 2110/10
See application file for complete search history.

(56) References Cited

U.S. PATENT DOCUMENTS 9,581,351 B2 * 2/2017 Kumamoto ..... F24F 11/79
10,136,549 B2 * 11/2018 Steiner ..... H05K 7/20209
(Continued)

FOREIGN PATENT DOCUMENTS

EP 1 319 900 6/2003
EP 2 484 986 8/2012
(Continued)

OTHER PUBLICATIONS

Boduch et al., Standards of Human Comfort, University of Texas at Austin School of Architecture, 2009. (Year: 2009).*
(Continued)

*Primary Examiner* — Kenneth J Hansen
*Assistant Examiner* — Phillip Decker
(74) *Attorney, Agent, or Firm* — Ked & Associates LLP

(57) ABSTRACT

A method of controlling a ceiling type air conditioner including a panel located on a ceiling surface, outlets formed at positions corresponding to four sides of the panel, a first vane group for opening and closing the outlets located at two opposing sides, and a second vane group for opening and closing the outlets located at the other two opposing sides includes performing a dynamic airflow mode in which an indoor temperature reaches a set temperature by controlling rotation angles of the first vane group and the second vane group, and calculating a pleasant airflow index Y for determining a pleasant feeling of a user at the set temperature. The pleasant airflow index is calculated using the indoor temperature, the rotation angle of the first vane group or the second vane group, an air volume, a distance from a floor surface and an airflow position as variables.

16 Claims, 7 Drawing Sheets
(2 of 7 Drawing Sheet(s) Filed in Color)

(51) Int. Cl.
*F24F 1/0047* (2019.01)
*F24F 110/10* (2018.01)

(56) References Cited

U.S. PATENT DOCUMENTS

| | | | | |
|---|---|---|---|---|
| 10,274,220 | B2 * | 4/2019 | Kojima | F24F 11/77 |
| 2012/0042662 | A1 * | 2/2012 | Kim | F24F 1/0007 62/56 |
| 2012/0097748 | A1 | 4/2012 | Kanaya et al. | |
| 2017/0159957 | A1 | 6/2017 | Park et al. | |

FOREIGN PATENT DOCUMENTS

| | | |
|---|---|---|
| JP | 6213539 | 10/2017 |
| KR | 10-2003-0008242 | 1/2003 |
| KR | 10-2003-0012046 | 2/2003 |
| KR | 10-2007-0060502 | 6/2007 |
| KR | 10-2007-0066292 | 6/2007 |
| KR | 10-2012-0120359 | 11/2012 |
| KR | 10-2013-0093366 | 8/2013 |
| KR | 10-2017-0065837 | 6/2017 |

OTHER PUBLICATIONS

Korean Notice of Allowance dated Jul. 24, 2020 issued in Application No. 10-2018-0055566.
International Search Report dated Aug. 9, 2019.
European Search Report dated Oct. 14, 2019.
Korean Office Action dated Jan. 28, 2020 issued in Application No. 10-2018-0055566.

* cited by examiner

| FACTOR | | CONVENTIONAL AIR CONDITIONER | PRESENT INVENTION (DYNAMIC AIRFLOW) |
|---|---|---|---|
| VERTICAL TEMPERATURE DISTRIBUTION |   |  |  |
| TIME REQUIRED TO DECREASE BY 1℃ | | 0:14:18 | 0:13:11 |
| TIME REQUIRED REACH SET TEMPERATURE | | 0:35:45 | 0:17:37 |

| FACTOR | | CONVENTIONAL AIR CONDITIONER | PRESENT INVENTION (DYNAMIC AIRFLOW) |
|---|---|---|---|
| VERTICAL TEMPERATURE DISTRIBUTION | 28°C<br>  <br>18°C |  |  |
| TIME REQUIRED TO DECREASE BY 1℃ | | 0:15:15 | 0:06:50 |
| TIME REQUIRED REACH SET TEMPERATURE | | 0:36:31 | 0:12:36 |

METHOD FOR CONTROLLING A CEILING TYPE AIR CONDITIONER

CROSS-REFERENCE TO RELATED APPLICATIONS

The present application claims priority under 35 U.S.C. 119 and 35 U.S.C. 365 to Korean Patent Application No. 10-2018-0055566 (filed on May 15, 2018) which is hereby incorporated by reference in its entirety.

BACKGROUND

The present invention relates to a method of controlling a ceiling type air conditioner.

An air conditioner is an apparatus for maintaining air of a predetermined space in a best state according to usage or purposes thereof. In general, the air conditioner includes a compressor, a condenser, an expansion device and an evaporator. A freezing cycle for performing compression, condensation, expansion and evaporation of refrigerant may be performed to cool or heat the predetermined space.

The predetermined space may be changed according to place where the air conditioner is used. For example, when the air conditioner is positioned in home or office, the predetermined space may be an indoor space of a house or building.

When the air conditioner performs cooling operation, an outdoor heat exchanger provided in an outdoor unit performs a condensation function and an indoor heat exchanger provided in an indoor unit performs an evaporation function. In contrast, when the air conditioner performs heating operation, the outdoor heat exchanger performs a condensation function and the indoor heat exchanger performs an evaporation function.

The air conditioner may be classified into an upright type, a wall-mounted type or a ceiling type according to the installation position thereof. The upright type air conditioner refers to an air conditioner standing up in an indoor space, and the wall- mounted type air conditioner refers to an air conditioner attached to a wall surface.

In addition, the ceiling type air conditioner is understood as an air conditioner installed in a ceiling. For example, the ceiling type air conditioner includes a casing embedded in a ceiling and a panel coupled to a lower side of the casing and including an inlet and an outlet formed therein.

Information on the related art is as follows.

1. Patent Publication No. (Publication Date): 2003-0008242 (Jan. 25, 2003)

2. Title of the Invention: Vane control method of ceiling type air conditioner

The related art discloses increasing the speed of discharged airflow by alternately performing opening and closing operation of opposing vanes using a plurality of stepping motors.

However, the related art has the following problems.

First, it takes a considerable time for an indoor temperature to reach a target set temperature by airflow discharged by the vanes.

Second, in the related art, the air conditioner is controlled using the same control method in cooling operation and heating operation. Specifically, if the same control as the cooling operation is performed in heating operation, even when relatively warm air is discharged from the ceiling by relatively cold indoor air, warm air flows to a point higher than an occupant (user) according to flow of air due to a temperature difference, thereby decreasing a pleasant feeling and increasing the rising time of an indoor temperature.

Third, a conventional air conditioner uses a predicted mean vote (PMV) control method in order to determine the pleasant feeling of the occupant (user). The PMV control method refers to a method of controlling an air conditioner by detecting a temperature, a radiant temperature, relative humidity, air velocity, the amount of activity and the amount of worn clothes, calculating a PMV index and evaluating thermal sensation.

However, the PMV control method has a limitation in determination of the pleasant feeling of the user due to direct influence of airflow reaching the user as the index of the thermal environment. Specifically, the PMV index at an air velocity of 0.5 m/s or more is not reliable due to a large difference from the actual pleasant feeling of the user.

Fourth, it is impossible to eliminate the unpleasant feeling of the user due to draft. The draft means a phenomenon wherein local convection current is caused by an indoor thermal environment, that is, a vertical or horizontal temperature difference, even when the appropriate temperature of an indoor floor is maintained in a room in which ventilation occurs.

That is, the temperature and the air velocity of the user's position are changed by draft. As a result, there is a difference between the actual pleasant feeling of the user and the pleasant feeling of the user determined by the conventional air conditioner.

SUMMARY

Embodiments provide a method of controlling a ceiling type air conditioner capable of rapidly satisfying the pleasant feeling of a user.

Embodiments provide a method of controlling a ceiling type air conditioner capable of improving a time required to reach a target set temperature in cooling or heating operation.

Embodiments provide a method of controlling a ceiling type air conditioner capable of performing control according to cooling operation or heating operation in order to enable an indoor temperature to rapidly reach a set temperature in consideration of an indoor environment in which cooling or heating is performed.

Embodiments provide a method of controlling a ceiling type air conditioner capable of continuously maintaining the pleasant feeling of a user.

Embodiments provide a method of controlling a ceiling type air conditioner capable of solving the problems of the PMV control method.

Embodiments provide a method of controlling a ceiling type air conditioner capable of eliminating the unpleasant feeling of a user caused by draft using an airflow unpleasant feeling index.

In one embodiment, a method of controlling a ceiling type air conditioner including a panel located on a ceiling surface, outlets formed at positions corresponding to four sides of the panel, a first vane group for opening and closing the outlets located at two opposing sides, and a second vane group for opening and closing the outlets located at the other two opposing sides includes performing a dynamic airflow mode in which an indoor temperature reaches a set temperature by controlling rotation angles of the first vane group and the second vane group.

In addition, the method may further include calculating a pleasant airflow index Y for determining a pleasant feeling of a user at the set temperature.

In addition, the pleasant airflow index may be calculated using the indoor temperature, the rotation angle of the first vane group or the second vane group, an air volume, a distance from a floor surface and an airflow position as variables.

The method may further include determining whether the calculated pleasant airflow index is equal to or greater than a predetermined reference value.

The method may further include newly calculating the rotation angle of the first vane group or the rotation angle of the second vane group satisfying the predetermined reference value or more, when the calculated pleasant airflow index is less than the predetermined reference value.

The method may further include rotating the first vane group or the second vane group by the newly calculated rotation angle.

The ceiling type air conditioner may further include a controller configured to control the rotation angle of the first vane group or the second vane group and the air volume of a fan.

In addition, a temperature detector configured to detect the indoor temperature, a height detector configured to detect the distance from the floor, and a memory configured to store the airflow position mapped to the detected distance from the floor may be further included.

The first vane group may be located in a vertical direction of the second vane group.

The method may further include calculating an airflow unpleasant feeling index indicating a degree of draft generated by an indoor vertical or horizontal temperature difference.

The method may further include changing the air volume when the calculated airflow unpleasant feeling index is greater than a predetermined reference value.

The performing of the dynamic airflow mode may include performing first mixing operation by positioning the first vane group at a first rotation angle a to generate horizontal airflow and positioning the second vane group at a second rotation angle a' different from the first rotation angle a to generate vertical airflow.

In addition, the performing of swing operation of rotating the first vane group and the second vane group at an angle between the first rotation angle a and the second rotation angle a' may be further included.

The horizontal airflow may be defined as airflow formed by discharged air flowing bidirectionally along the ceiling surface, and the vertical airflow may be defined as airflow formed by discharged air flowing toward the floor surface.

The method may further include performing second mixing operation by positioning the first vane group at the second rotation angle a' to generate the vertical airflow and positioning the second vane group at the first rotation angle a to generate the horizontal airflow.

The first mixing operation and the swing operation may be performed for a predetermined time.

The performing of the dynamic airflow mode may further include determining whether cooling operation or heating operation is performed.

Upon determining that the heating operation is performed, the swing operation may be replaced with fixing operation of setting the first rotation angle and the second rotation angle to the same angle.

In the fixing operation, the first vane group and the second vane group may form the vertical airflow.

The first rotation angle a may be set to an angle greater than 20° and less than 40°.

The second rotation angle a' may be set to an angle greater than 60° and less than 80°.

According to the present invention, it is possible to further shorten a time required for an indoor temperature to reach a target set temperature in cooling or heating operation, by generating dynamic airflow in an indoor space. Therefore, it is possible to improve user's satisfaction with a product.

In addition, according to the present invention, it is possible to rapidly give the user a pleasant feeling based on indoor environments which differ between cooling or heating, by performing dynamic airflow operation according to cooling or heating operation. That is, it is possible to provide optimal performance according to an operation mode.

According to the present invention, since a pleasant airflow index capable of more accurately determining the pleasant feeling of the user relative to influence of airflow than the conventional PMV control method, it is possible to more reliably determine the pleasant feeling of the user.

According to the present invention, by determining the unpleasant feeling of the user due to draft and performing control to maintain an appropriate pleasant feeling, a user can maintain the pleasant feeling for a long time and a dead zone of airflow can be eliminated.

According to the present invention, it is possible to minimize the local unpleasant feeling of the user due to the draft phenomenon, by minimizing a horizontal or vertical temperature difference of a user's position.

BRIEF DESCRIPTION OF THE DRAWINGS

The patent or application file contains at least one drawing executed in color. Copies of this patent or patent application publication with color drawings(s) will be provided by the Office upon request and payment of the necessary fee.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s).

Figure 1:
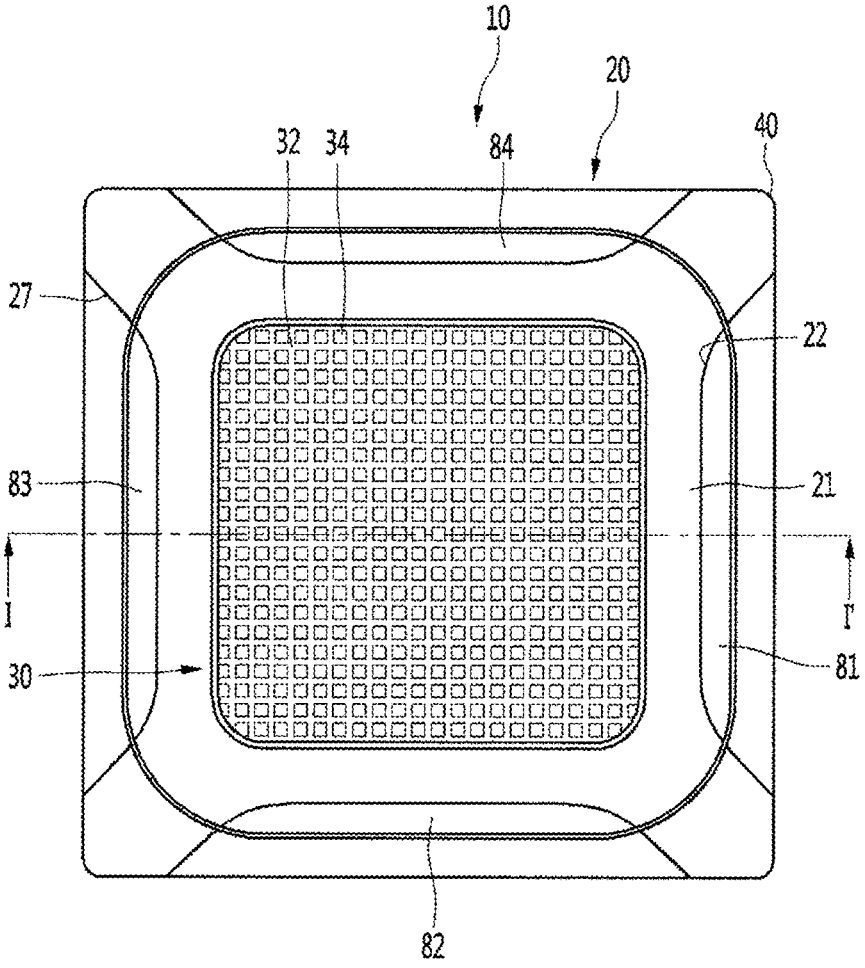
FIG. 1 is bottom view showing the configuration of a ceiling type air conditioner according to an embodiment of the present invention.
Figure 2:
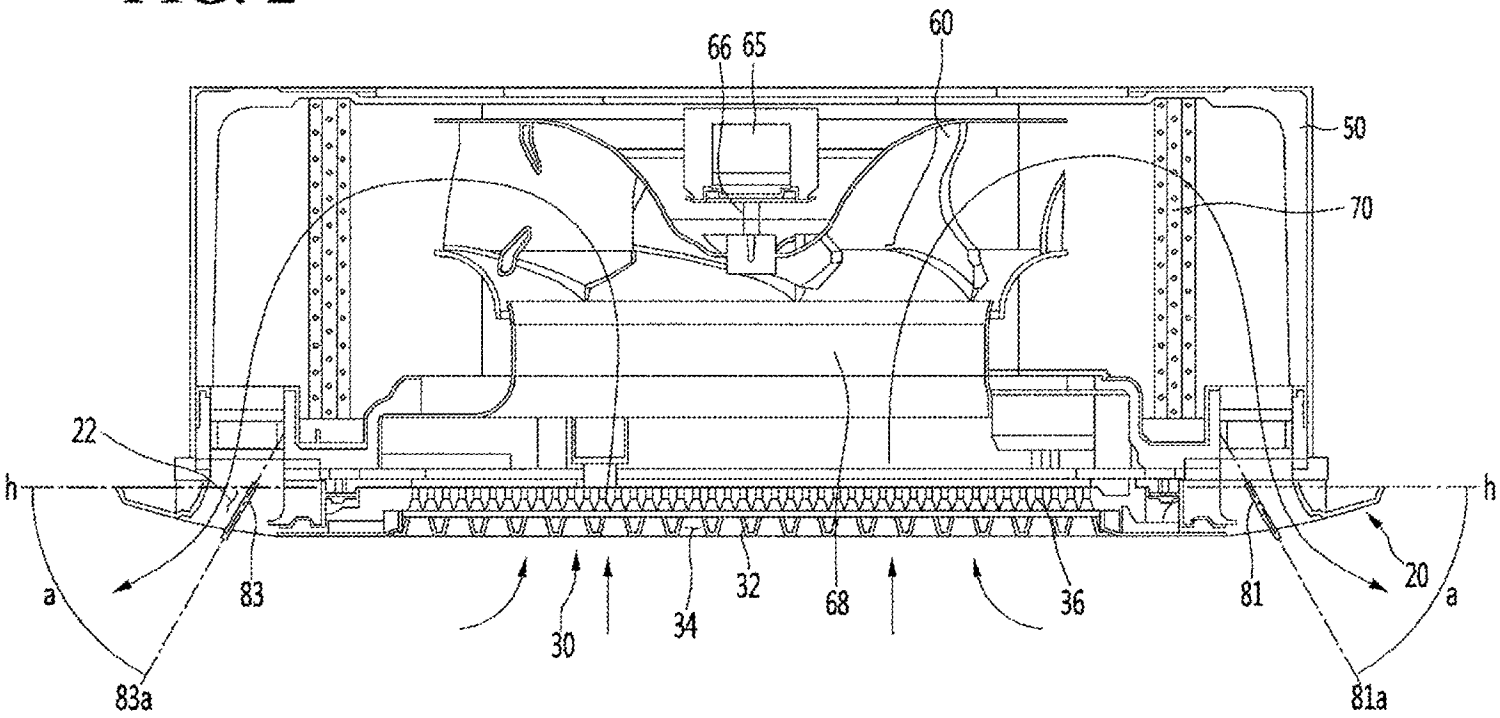
FIG. 2 is a cross-sectional view taken along line I-I' of FIG. 1.
Figure 3:
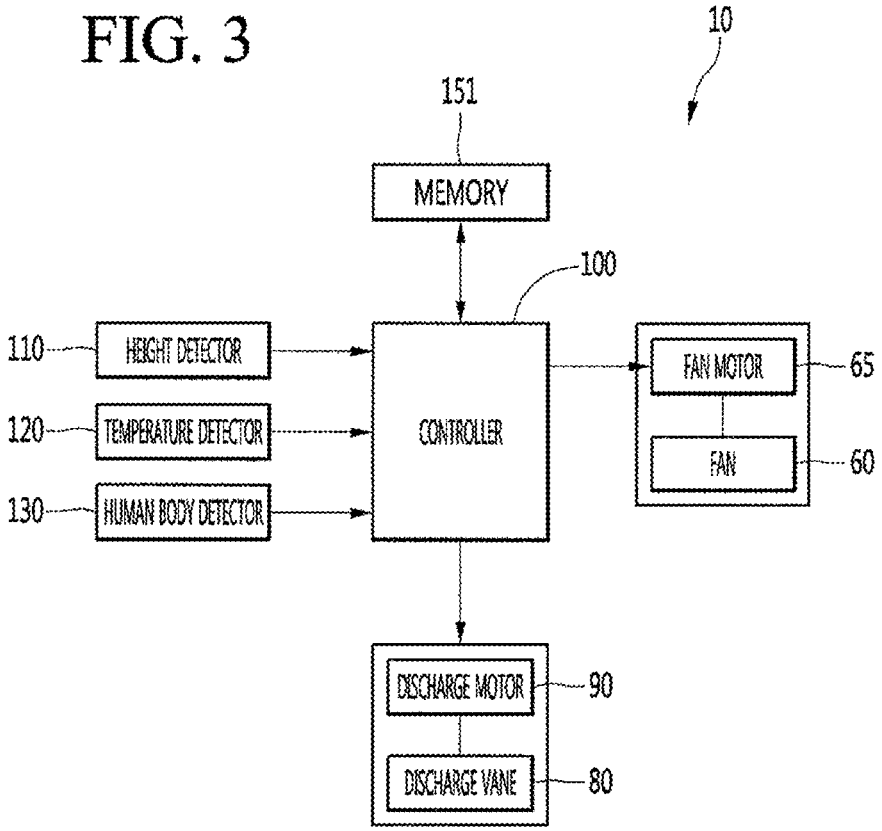
FIG. 3 is a block diagram showing the configuration of a ceiling type air conditioner according to an embodiment of the present invention.

FIG. 1 is bottom view showing the configuration of a ceiling type air conditioner according to an embodiment of the present invention, FIG. 2 is a cross-sectional view taken along line I-I' of FIG. 1, and FIG. 3 is a block diagram showing the configuration of a ceiling type air conditioner according to an embodiment of the present invention.

Referring to FIGS. 1 to 3, the ceiling type air conditioner 10 (hereinafter referred to as an air conditioner) according to the embodiment of the present invention includes a casing 50 and a panel 20.

The casing 50 is embedded in the internal space of a ceiling and the panel 20 is substantially located at a height of the ceiling to be exposed to the outside. A plurality of parts may be installed in the casing 50.

The plurality of parts includes a heat exchanger 70 for exchanging heat with air sucked into the casing 50.

The heat exchanger 70 may be disposed to be bent multiple times along the inner surface of the casing 50 and to surround a fan 60.

The plurality of parts further includes a fan 60 driven for suction and discharge of indoor air and an air guide 68 for guiding air sucked toward the fan 60.

The fan 60 is coupled with a motor shaft 66 of a fan motor 65. The fan 60 may rotate by driving the fan motor 65.

The air guide 68 is disposed at the suction side of the fan 60 to guide air sucked through an inlet 34 toward the fan 60. For example, the fan 60 may include a centrifugal fan.

The panel 20 is mounted on the lower end of the casing 50 and may be substantially formed in a rectangular shape when viewed from the lower side thereof.

In addition, the panel 20 may be formed to protrude outward from the lower end of the casing 50 and a circumference thereof may be in contact with a lower surface (ceiling surface) of the ceiling. Here, the outside of the lower end of the casing 50 may be a direction toward the floor surface of a room or the ground.

The panel 20 includes a panel body 21 and outlets 22, through which air of the internal space of the casing 50 is discharged.

The outlets 22 may be formed by perforating at least a portion of the panel body 21 and may be formed at positions corresponding to four sides of the panel body 21. The outlets 22 may be elongated along the longitudinal directions of the sides of the panel 20.

The air conditioner 10 further includes a discharge vane 80 for opening and closing the outlets 22 and a discharge motor 90 for rotating the discharge vane 80.

The discharge vane 80 may be mounted in the panel 20. The discharge vane 80 may be formed in a shape corresponding to the opening shape of the outlet 22. Accordingly, the discharge vane 80 may open or close the outlets 22 formed at the four sides of the panel 20.

The discharge vane 80 includes a first discharge vane 81, a second discharge vane 82, a third discharge vane 83 and a fourth discharge vane 84 for opening and closing the outlets 22 formed at the four sides of the panel 20.

The first discharge vane 81 and the third discharge vane 83 are positioned in directions opposite to each other. The second discharge vane 82 and the fourth discharge vane 84 are positioned in directions opposite to each other.

The first vane 81 and the third discharge vane 83 may be positioned perpendicular to the second discharge vane 82 and the fourth discharge vane 84.

The longitudinal directions (or the extending directions) of the first and third discharge vanes 81 and 83 may be perpendicular to those of the second and fourth discharge vanes 82 and 84.

In FIG. 1, the first discharge vane 81 is spaced apart from the third discharge vane 83 in a horizontal direction and the second discharge vane 82 is spaced apart from the fourth discharge vane 83 in a vertical direction.

That is, the first discharge vane 81 and the third discharge vane 83 are provided to open and close the outlets 22 formed in the vertical direction and the second discharge vane 82 and the fourth discharge vane 84 are provided to open and close the outlets 22 formed in the horizontal direction.

The first discharge vane 81 and the third discharge vane 83 rotate at the same angle and the second discharge vane 82 and the fourth discharge vane 84 rotate at the same angle.

Here, the first discharge vane 81 and the third discharge vane 83 are defined as a first vane group and the second discharge vane 82 and the fourth discharge vane 84 are defined as a second vane group.

That is, the first vane group may include the first discharge vane 81 and the third discharge vane 83 for opening and closing the outlets 22 located at two opposing sides.

The second vane group may be located perpendicular to the first vane group and include the second discharge vane 82 and the fourth discharge vane for opening and closing the outlets 22 located at the other two opposing sides.

Referring to FIG. 2, a virtual horizontal line parallel to the ground forming a horizontal surface or a ceiling surface, on which the panel 20 is mounted, and passing through the rotation center of the third discharge vane 83 from the rotation center of the first discharge vane 81 is defined as a horizontal reference line h.

Virtual straight lines drawn along the width direction of the discharge vane 80, that is, the longitudinal section of the discharge vane 80, are defined as extension lines 81*a* and 83*a*.

An angle a between the horizontal reference line h and the extension line 81*a* of the first discharge vane according to rotation of the first discharge vane 81 is equal to an angle a between the horizontal reference line h and the extension line 83*a* of the third discharge vane according to rotation of the third discharge vane 83.

Accordingly, the angle a between the horizontal reference line h and the extension line 81*a* or 83*a* according to rotation of the first vane group 81 and 83 is defined as a first rotation angle a.

The second vane group 82 and 84 is positioned perpendicular to the first vane group 81 and 83 and has the same configuration as the first vane group 81 and 83.

Accordingly, the description of the horizontal reference line h and the extension lines of the first vane group 81 and 83 is applicable to the second vane group 82 and 84 disposed perpendicular to the first vane group.

Specifically, a horizontal line from the second discharge vane 82 to the fourth discharge vane 84 to be parallel to the ground forming the horizontal surface or the ceiling surface, on which the panel 20 is mounted, is defined as a vertical reference line.

An angle between the vertical reference line and the extension line of the second discharge vane according to rotation of the second discharge vane 82 is equal to an angle between the vertical reference line and the extension line of the fourth discharge vane according to rotation of the fourth discharge vane 84.

Accordingly, an angle between the vertical reference line and the extension line according to rotation of the second vane group 82 and 84 is defined as a second rotation angle a'.

The first rotation angle a and the second rotation angle a' may be differently set.

The discharge motor 90 may be connected to the discharge vane 80 to provide power. In addition, the discharge motor 90 may rotate the discharge vane 80 and the outlets 22 may be opened and closed by rotation of the discharge vane 80. For example, a plurality of discharge motors 90 may be provided to be connected to the discharge vanes 81, 82, 83 and 84.

In addition, the discharge motor 90 may include a step motor.

A suction grill 30 is mounted at the center of the panel 20. The suction grill 30 forms the lower appearance of the air conditioner 10 and has a substantially rectangular frame shape.

The suction grill 30 includes a grill body 32 including an inlet 34.

The grill body 32 may have a grid shape.

A filter member 36 for filtering air sucked through the inlet 34 is provided on the grill body 32. For example, the filter member 36 may have a substantially rectangular frame shape.

The outlets 22 may be disposed outside the suction grill 30. That is, the outlets 22 may be located outside the suction grill 30 and may be disposed in four directions. For example, the outlets 22 may be provided outside the inlet 34 in the up, down, left and right directions.

By disposing the inlet 34 and the outlets 22, air of the indoor space is sucked into and conditioned in the casing 50 by the central portion of the panel 20, and the conditioned air may be discharged through the outlets 22 to the outside of the panel 20 in four directions.

Cover mounting portions 27 are formed at four corners of the panel body 21.

The cover mounting portions 27 may be formed by perforating at least a portion of the panel body 21. The cover mounting portions 27 are used to check the services of the plurality of parts mounted on the rear surface of the panel 20 or operation of the air conditioner 10 and may be configured to be opened or closed by the cover member 40.

Air flow in the air conditioner 10 will be briefly described. When the fan motor 65 is driven to generate rotation force in the fan 60, air of the indoor space is sucked through the inlet 34 and is filtered by the filter member 36. The sucked air flows to the fan 60 through the inner space of the air guide 68 and the flow direction of air is changed through the fan 60.

Air sucked through the inlet 34 flows upward, flows into the fan 60, and flows to the outside through the fan 60. Air passing through the fan 60 is heat- exchanged through the heat exchanger 70 and the heat-exchanged air flows downward, thereby being discharged through the outlets 22.

That is, air is sucked through the suction grill 30 located at the center of the panel 20 and is discharged through the outlets 34 after flowing from the casing 50 toward the outside of the suction grill 30.

The air conditioner 10 further includes a controller 100 for controlling the fan motor 65 and the discharge motor 90.

The controller 100 may control the fan motor 65 in order to control an air volume or a wind speed. Accordingly, the controller 100 may control rotation of the fan 60 connected to the fan motor 65

In addition, the controller 100 may control rotation of the discharge motor 90. For example, the controller 100 may control the rotation angle or the rotation direction of the discharge vane 80, by controlling the rotation angle or the rotation angle of the discharge motor 90.

As a result, the controller 100 may control the first rotation angle a of the first vane group 81 and 83 and the second rotation angle of the second vane group 82 and 84, by controlling the discharge motor 90.

The air conditioner 10 further includes a height detector 110 for detecting the height of the ceiling, a temperature detector 120 for detecting the temperature of the indoor space and a human body detector 130 for detecting presence of a user (occupant) located indoors.

The height detector 110 may include a distance detection sensor for detecting a distance between the floor surface of an installation space and the ceiling. For example, the height detector 110 may be installed on the front surface of the panel 20.

The height detector 10 may perform a function for detecting a distance for calculating a pleasant airflow index Y.

The temperature detector 125 may include a temperature detection sensor. The temperature detector 125 may detect and transmit an indoor temperature to the controller 100. Accordingly, the controller 100 may determine whether to reach a target temperature set by the user based on the result of detection of the temperature detector 125.

The temperature detector 125 may perform a function for detecting an indoor temperature for calculating a pleasant airflow index Y.

The human body detector 130 may include an infrared detection sensor for detecting a user (occupant) and a distance detection sensor for determining the position of the user. The human body detector 130 may transmit the result of detection to the controller 100.

The human body detector 130 may perform a function for detecting an airflow position for calculating the pleasant airflow index Y.

The air conditioner 10 further includes a memory 151 for storing data.

The memory 151 may store predetermined information for operation of the air conditioner. In addition, the controller 100 may transmit and receive data to and from the memory 151. Accordingly, the controller 100 may read and written data from and in the memory 151.

In the memory 151, an airflow position corresponding to the height of the ceiling detected by the height detector 110 may be stored.

For example, if the height of the ceiling is 3 m, information defining the airflow position corresponding to the height of the ceiling as an area of 0.6 to 1.7 m from the indoor floor surface may be pre-stored in the memory 151.

Here, the airflow position may be understood as an airflow arrival position. In addition, the airflow arrival position may be understood as a predicted user position.

For example, when the information detected by the human body detector 130 is not received, the controller 100 may load the airflow position from the memory 151, in order to calculate the pleasant airflow index Y.

Figure 4:
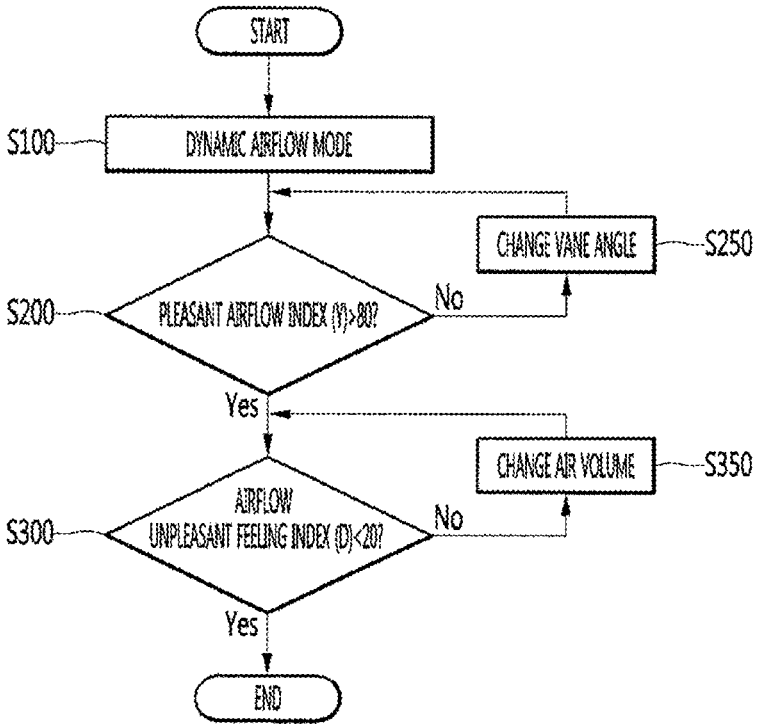
FIG. 4 is a flowchart illustrating a method of controlling a ceiling type air conditioner according to an embodiment of the present invention.

FIG. 4 is a flowchart illustrating a method of controlling a ceiling type air conditioner according to an embodiment of the present invention.

Referring to FIG. 4, the air conditioner 10 according to the embodiment of the present invention may operate in a dynamic airflow mode in an indoor environment in which cooling operation or heating operation is performed (S100).

The dynamic airflow mode may be understood as an operation mode in which the indoor temperature of a space where the air conditioner 10 is installed rapidly reaches a temperature set by the user.

The user may select the dynamic airflow operation during the cooling operation in order to rapidly decrease the indoor temperature in the summer using an operation unit such as a remote controller or a touch panel. At this time, the controller 100 may receive a signal from the operation unit and control the air conditioner 10 to enter the dynamic airflow mode (S100). The dynamic airflow mode S100 will be described below in detail.

The air conditioner 10 according to the embodiment of the present invention may perform operation for satisfying or maintaining the pleasant feeling of the user (S200 and S300), when the indoor temperature reaches the (target) temperature set by the user (occupant) by the dynamic airflow mode (S100)

Specifically, when the indoor temperature reaches the set temperature by the dynamic airflow mode S100, the air conditioner 10 may calculate the pleasant airflow index Y.

In addition, the air conditioner 10 may determine whether the value of the pleasant airflow index Y is greater than a predetermined reference value. Here, the predetermined reference value is defined as 80 (S200).

The pleasant airflow index Y may be defined as an index capable of solving the problem of the airflow element of the conventional predicted mean vote (PMV) control method and more rapidly and accurately determining the pleasant feeling of the user.

The pleasant airflow index Y may be calculated using the indoor temperature t (unit: °C.), the angle a of the discharge vane 80 (unit: degree), an air volume c (unit: CMM), a distance from the floor surface d (unit: m) and an airflow position e (unit: m) as variables.

Here, the angle a of the discharge vane 80 is based on the first rotation angle a.

That is, the pleasant airflow index Y is an equation representing a relationship between the above-described variables and the pleasant feeling of the user.

For example, if the indoor temperature t is lower than the set temperature by the dynamic airflow mode S100 during cooling operation, the angle of the discharge vane, the air volume, the distance and the airflow position are variables significantly affecting the pleasant feeling of the user.

In addition, the angle a of the discharge vane 80 becomes a variable significantly affecting the pleasant feeling of the user in the relationship with the air volume as the value thereof decreases.

In addition, the distance d becomes a variable significantly affecting the pleasant feeling of the user in the relationship with the angle a of the discharge vane as the value thereof increases.

In addition, the air volume c becomes a variable significantly affecting the pleasant feeling of the user in the relationship with the airflow position as the value thereof decreases.

Equation 1 below is an equation for calculating the pleasant airflow index Y reflecting the relationship between the above-described variables and the pleasant feeling of the user.

$$\begin{aligned}\text{Pleasant airflow index } Y = {} & -887+40.65*t+15.04*a- \\ & 0.6899*c+406.3*d+74.7*e-0.6321*t*a+ \\ & 0.01583*t*c-16.47*t*d-1.78*t*e+ \\ & 0.004623*a*c-4.928*a*d-0.524*a*e+ \\ & 0.0870*c*d-81.6*d*e+0.2069*t*a*d+ \\ & 2.690*t*d*e-0.001516*a*c*d+0.1773*a*d*e \qquad \text{Equation 1}\end{aligned}$$

In addition, if the pleasant airflow index Y calculated by Equation 1 above has a value of 80 or more, it may be determined that the pleasant feeling of the user is maintained or improved. That is, if the pleasant airflow index Y is greater than 80, the user may be defined as maintaining a pleasant feeling.

The controller 100 may calculate the pleasant airflow index Y based on information detected by the height detector 110, the temperature detector 120 and the human body detector 130, information on the rotation angle a of the discharge vane 80 according to the rotation angle of the discharge motor 90 and information on the air volume according to the number of rotation of the fan motor 65.

The controller 100 may determine whether the calculated pleasant airflow index has a value of 80 or more.

Upon determining that the calculated pleasant airflow index has a value of less than 80, the controller 100 may change the rotation angle a of the discharge vane 80 such that the pleasant airflow index satisfies the value of 80 or more (S250).

For example, the controller 100 may calculate the angle of the discharge vane 80 satisfying the pleasant airflow index of 80 or more using the rotation angle of the discharge vane 80 as unknown. The controller 100 may control the discharge motor 90 in order to rotate the discharge vane 80 by the calculated angle.

The changed angle of the discharge vane 80 is the first rotation angle a as described above. Accordingly, the controller 100 may perform control to add or subtract the second rotation angle a' by a difference between the existing first rotation angle and the changed first rotation angle. Accordingly, it is possible to maintain or improve the pleasant feeling of the user by maintaining the pleasant airflow index of 80 or more.

When the pleasant airflow index Y satisfies a value of 80 or more, the air conditioner 10 may perform control to calculate an airflow unpleasant feeling index D to be less than a reference value. Here, the reference value of the airflow unpleasant feeling index D may be set to 20 (S300).

The airflow unpleasant feeling index D represents a degree of draft of giving an unpleasant feeling to the user as local convection generated by the above- described vertical or horizontal temperature difference.

The airflow unpleasant feeling index D may be calculated by an indoor temperature Ta (unit: °C.), an average air velocity v (unit: m/s), and a turbulence intensity Tu (unit: %) as variables. The turbulence intensity Tu is obtained by dividing an interval standard deviation by the average air velocity v.

Equation 2 below is an equation of calculating the airflow unpleasant feeling index D.

$$\text{airflow unpleasant feeling index}(D)=([34-Ta]*[v-0.05]^{0.62})*(0.37*v*Tu+3.14) \quad \text{Equation 2}$$

When the airflow unpleasant feeling index D is greater than 20, the controller 100 may change the air volume such that the airflow unpleasant feeling index D has a value of 20 or less. That is, the controller 100 may control the fan motor 65 to change the air volume (S350).

Since the air volume (unit: CMM) is equal to a product of the discharge cross-sectional area (m^2) and a flow rate (m/min), when the controller 100 changes the air volume, the average air velocity v may be changed to decrease the airflow unpleasant feeling index D. For example, the controller 100 may decrease the average air velocity v, by controlling the air volume to be less than a current air volume.

Accordingly, it is possible to minimize or prevent a draft phenomenon in which local convection is caused to give the user an unpleasant feeling.

Figure 5:
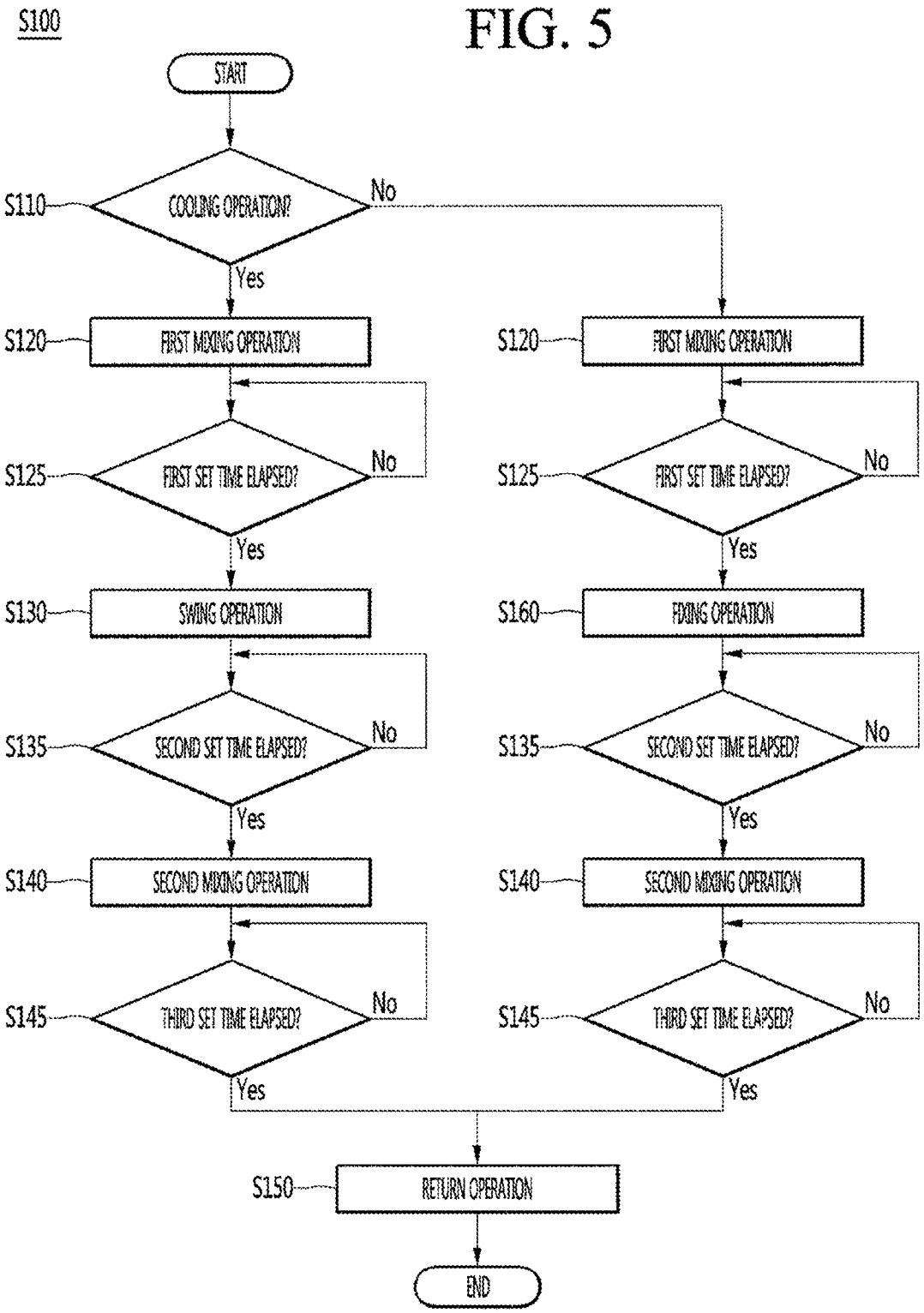
FIG. 5 is a flowchart illustrating a control method for dynamic airflow generation of a ceiling type air conditioner according to an embodiment of the present invention.

FIG. 5 is a flowchart illustrating a control method for dynamic airflow generation of a ceiling type air conditioner according to an embodiment of the present invention. Specifically, FIG. 5 is a flowchart illustrating a detailed control method of the dynamic airflow mode of FIG. 4.

Referring to FIG. 5, the air conditioner according to the embodiment of the present invention may determine whether cooling operation is performed (S110) in the dynamic airflow mode S100.

As described above, an indoor environment in which the air conditioner 10 is installed may have environmental conditions which differ between the heating operation and the cooling operation. For example, when the heating operation is performed, warm air rises by relatively cold indoor air. Accordingly, a temperature rising time increases at the user's position where warmth or a pleasant feeling may be substantially provided.

Accordingly, the controller 100 may first determine whether the air conditioner 10 performs cooling operation or heating operation (S110) when entering the dynamic airflow mode S100 and perform control to generate optimal dynamic airflow reflecting the indoor environmental conditions according to the operation.

That is, the air conditioner 10 according to the embodiment of the present invention may generate optimal dynamic airflow suitable for the indoor environment according to the cooling operation or the heating operation. Therefore, the indoor temperature can rapidly reach the temperature set by the user.

The air conditioner 10 may perform control to perform first mixing operation in order to generate dynamic airflow (S120).

The first mixing operation S120 may be defined as operation in which the first vane group 81 and 83 forms horizontal airflow and the second vane group 82 and 84 forms vertical airflow.

Specifically, in the first mixing operation, the first rotation angle a may be set to an angle greater than 20° and less than 40°. For example, the first rotation angle a may be set to 30°. Accordingly, the first vane group 81 and 83 is positioned at the first rotation angle) (30° to guide air discharged through the outlets 22 to both sides, thereby forming the horizontal airflow.

In addition, in the first mixing operation, the second rotation angle a' may be set to an angle greater than 60° and less than 80°. For example, in the first mixing operation, the second rotation angle a' may be set to 70°. Accordingly, the second vane group 82 and 84 is positioned at the first rotation angle) (70° to guide air discharged through the outlets 22 downward, thereby forming the vertical airflow.

In the first mixing operation, the controller 100 may control the discharge motor 90 to rotate the first vane group 81 and 83 and the second vane group 82 and 84 by the set angle.

Here, the horizontal airflow may be defined as airflow formed by discharging air from the discharge vane 80 toward sidewalls located at both sides of the indoor space, and may be understood as airflow flowing laterally at a high position relatively close to the ceiling surface in the indoor space.

In addition, the vertical airflow may be defined as airflow formed by discharging air from the discharge vane 80 toward an indoor floor surface and may be understood as airflow flowing downward toward a low position relatively close to the floor surface in the indoor space.

The controller 100 may determine whether the execution time of the first mixing operation has exceeded a predetermined first set time (S125).

For example, the first set time may be set to 5 minutes.

The first mixing operation is performed for the first set time. Air discharged from the first vane group 81 and 83 may flow toward the sidewalls of the indoor space along the ceiling surface to form horizontal airflow (see FIG. 6) and air discharged from the second vane group 82 and 84 may form vertical airflow flowing toward the floor surface of the indoor space (see FIG. 6).

Accordingly, in the case of the heating operation, in the first mixing operation, an indoor temperature may be lowered as horizontal airflow flowing on both sidewalls of the room and vertical airflow spreading from the center of the floor surface in a radial direction are mixed.

When the first set time has elapsed, the controller 10 may perform control to perform swing operation (S130).

The swing operation may be defined as operation in which the first vane group 81 and 83 and the second vane group 82 and 84 continuously and reciprocally rotate at an angle between the first rotation angle a and the second rotation angle a' set in the first mixing operation.

For example, in the swing operation, the controller 100 may control the first vane group 81 and 83 to continuously rotate between 30° (maximum angle) which is the first rotation angle a and 70° (minimum angle) which is the second rotation angle a', which are set in the first mixing operation, with elapse of time. Similarly, the controller 100 may control the second vane group 82 and 84 to continuously rotate between 70° which is the second rotation angle a' and 30° which is the first rotation angle a, which are set in the first mixing operation, with elapse of time.

Meanwhile, in the first mixing operation, the temperature of an indoor delay space in which the horizontal airflow or the vertical airflow does not reach or the arrival time of the horizontal airflow or the vertical airflow is delayed may be relatively slowly lowered.

According to the swing operation, since a mixing range of the vertical airflow and the horizontal airflow is widened, it is possible to minimize the indoor delay space such that the indoor temperature is more rapidly lowered.

The controller 100 may determine whether the execution time of the swing operation has exceeded a predetermined second set time (S135).

For example, the second set time may be set to 5 minutes.

Meanwhile, in the first mixing operation, since the first vane group 81 and 83 guides air in a lateral direction and the second vane group 82 and 84 guides air in an upward-and-downward direction, a dead zone may be formed in a forward-and- backward direction of the indoor space perpendicular to the lateral direction despite the swing operation. The temperature of the dead zone may be lowered more slowly than that of the other indoor space.

That is, in order for the temperature of the dead zone, which is not covered by the first mixing operation and the swing operation, to rapidly reach the set temperature, the controller 100 may perform control to perform second mixing operation when the second set time has elapsed (S140).

Specifically, in the second mixing operation, the first rotation angle a may be set to an angle greater than 60° and less than 80°. For example, the first rotation angle a may be set to 70°. Accordingly, the first vane group 81 and 83 is positioned at the first rotation angle) (70° to guide air discharged through the outlets 22 downward, thereby forming the vertical airflow.

In addition, in the second mixing operation, the second rotation angle a' may be set to an angle greater than 20° and less than 40°. For example, in the second mixing operation, the second rotation angle a' may be set to 30°. Accordingly, the second vane group 82 and 84 is positioned at the second rotation angle) (30° to guide air discharged through the outlets 22 forward and backward, thereby forming the horizontal airflow.

In the second mixing operation, the controller 100 may control the discharge motor 90 in order to rotate the first vane group 81 and 83 and the second vane group 82 and 84 by newly set rotation angles.

That is, the second mixing operation S140 may be understood as operation in which the rotation angles of the first vane group 81 and 83 and the second vane group 82 in the first mixing operation are exchanged with each other to eliminate the dead zone.

Accordingly, the indoor temperature of the dead zone which is not covered by the first mixing operation and the swing operation may be rapidly lowered through the second mixing operation.

The controller 100 may determine whether the execution time of the second mixing operation has exceeded a predetermined third set time (S145).

For example, the third set time may be set to 5 minutes.

The second mixing operation is performed for the third set time. Air discharged from the first vane group 81 and 83 may form vertical airflow flowing toward the floor surface of the indoor space (see FIG. 6) and air discharged from the second vane group 82 and 84 may flow toward the walls located in the forward-and-backward direction of the indoor space along the ceiling surface to form horizontal airflow (see FIG. 6).

The forward-and-backward direction may be understood as a direction perpendicular to the sidewall direction of the first mixing operation.

Accordingly, in the case of the cooling operation, in the second mixing operation, since the dead zone of the first mixing operation and the swing operation can be eliminated by mixing the horizontal airflow flowing along the walls located in the forward-and-backward direction of the indoor space and the vertical airflow spreading from the center of the floor surface of the indoor space in the lateral direction, the indoor temperature of the indoor space may be rapidly lowered.

In summary, the first mixing operation S120 and the second mixing operation S140 may be understood as operation in which the first vane group 81 and 83 and the second vane group 82 and 84 are positioned at different rotation angles to generate the horizontal airflow or the vertical airflow.

When the third set time has elapsed, the controller 100 may perform control to perform return operation (S150).

The return operation may be defined as operation of performing the swing operation and the first mixing operation in the reverse order.

Specifically, when the third set time has elapsed, the controller 100 may perform control such that the swing operation is performed for the second set time. Accordingly, the first vane group 81 and 83 and the second vane group 82 and 84 may continuously rotate between 30° and 70°.

In addition, when the third set time has elapsed again, the controller 100 may perform control such that the first mixing operation is performed. Accordingly, the first vane group 81 and 83 may rotate at 30° and the second vane group 82 and 84 at 70° to guide air discharged through the outlet 22 for the first set time.

Through the return operation, the temperature of a position where the temperature rises due to outdoor air or ventilation during the second mixing operation is lowered again, thereby rapidly lowering the entire indoor temperature.

When the first set time has elapsed again, the dynamic airflow mode may be finished.

That is, the air conditioner 10 may perform the first mixing operation, the swing operation, the second mixing operation, the swing operation and the first mixing operation in this order, thereby generating dynamic airflow. Therefore, since the temperature of the indoor space where the air conditioner 10 is installed can be lowered without the dead zone, it is possible to reduce the time required to reach the set temperature.

Hereinafter, a control method of generating dynamic airflow upon determining that the heating operation is performed instead of the cooling operation in step S110 will be described.

Even upon determining that the heating operation is performed in step S110, the air conditioner 10 may perform the first mixing operation S120, the second mixing operation S140 and the return operation S150 similarly to the cooling operation.

Accordingly, for the control method of generating dynamic airflow during the heating operation, refer to the description of the first mixing operation S120, the second mixing operation S140 and the return operation S150 of the cooling operation.

Meanwhile, the swing operation in the control method of generating the dynamic airflow during the cooling operation may be excluded in the control method of generating the dynamic airflow during the heating operation.

As described above, the environmental conditions when heating is necessary in the indoor space are different from the environmental conditions when cooling is necessary.

Specifically, when the swing operation is performed in a room requiring heating, relatively warm air rises and the temperature of a space where the user is located is relatively lowered. That is, a time required for the temperature of a user activity area to reach the set temperature may be increased. Accordingly, in the control method of generating the dynamic airflow during the heating operation, the swing operation may be replaced with the fixing operation.

That is, the air conditioner 10 for generating the dynamic airflow during the heating operation may perform the fixing operation (S160) when a first set time has elapsed (S125) after the first mixing operation S120.

The fixing operation S160 may be defined as operation of enabling the first vane group 81 and 83 and the second vane group 82 and 84 having the same rotation angle and guiding air discharged through the outlets 22.

Specifically, in the fixing operation, the first rotation angle a and the second rotation angle a' may be set to an angle greater than 60° and less than 80°. For example, in the fixing operation, the first rotation angle a and the second rotation angle a' may be set to 70°.

Accordingly, the first vane group 81 and 83 and the second vane group 82 and 84 may rotate at the set rotation angle) (70° to guide air discharged through the outlets 22 downward.

The controller 100 may determine whether the execution time of the fixing operation has elapsed a predetermined second set time (S135).

For example, the second set time may be set to 5 minutes.

Accordingly, when the temperature of the indoor space is relatively low and thus heating is necessary, it is possible to continuously provide warm air to the floor of the indoor space through the fixing operation. Accordingly, warm air is intensively provided to the lower portion, in which the user is located, of the indoor space, thereby rapidly increasing the temperature of the portions in which the user is located, and warm air discharged to the entire indoor space is rapidly convected, thereby rapidly increasing the indoor temperature to the set temperature.

That is, since it is possible to rapidly increase the entire indoor temperature and to relatively rapidly increase the temperature of a local space in which the user is located, it is possible to rapidly provide substantial heating effect.

Figure 6:
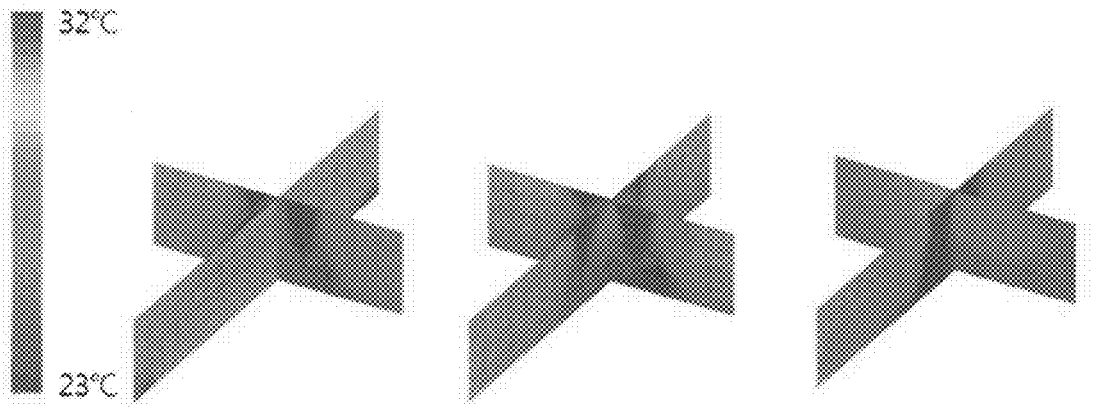
FIG. 6 is an experimental graph showing airflow discharged when cooling operation of FIG. 5 is performed.
Figure 7:
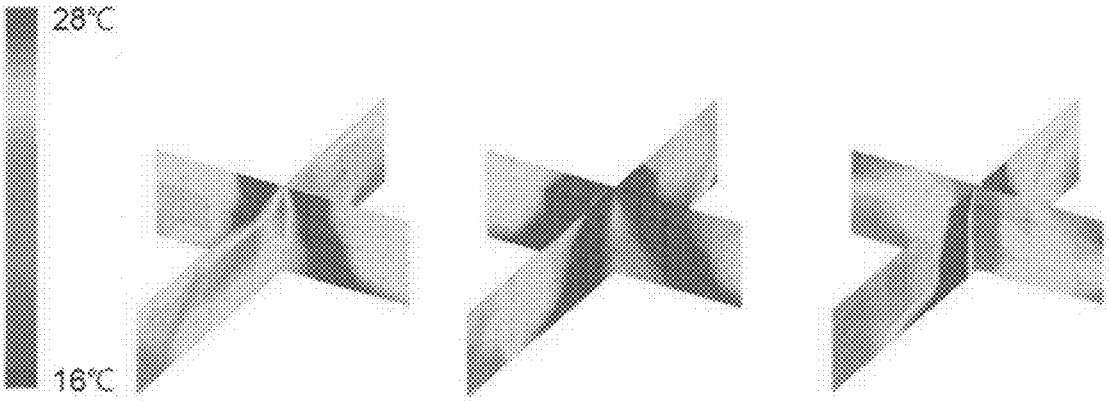
FIG. 7 is an experimental graph showing airflow discharged when heating operation of FIG. 5 is performed.
Figure 8:
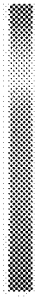
FIG. 8 is a table showing an experimental result of comparing a conventional ceiling type air conditioner with a ceiling type air conditioner according to the embodiment of the present invention in terms of a time required to reach a set temperature in cooling operation.
Figure 8:
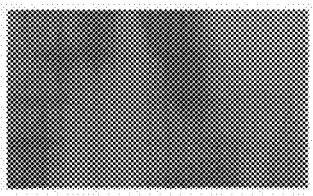
Figure 8:
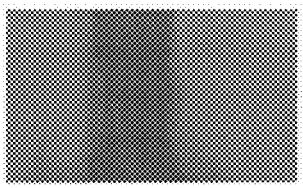
Figure 9:
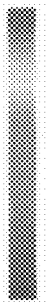
FIG. 9 is a table showing an experimental result of comparing a conventional ceiling type air conditioner with a ceiling type air conditioner according to the embodiment of the present invention in terms of a time required to reach a set temperature in heating operation.
Figure 9:
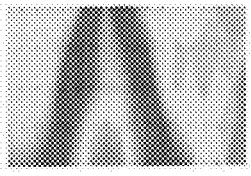
Figure 9:
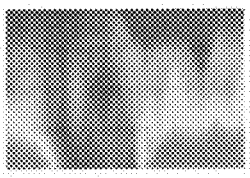

FIG. 6 is an experimental graph showing airflow discharged when cooling operation of FIG. 5 is performed, FIG. 7 is an experimental graph showing airflow discharged when heating operation of FIG. 5 is performed, FIG. 8 is a table showing an experimental result of comparing a conventional ceiling type air conditioner with a ceiling type air conditioner according to the embodiment of the present invention in terms of a time required to reach a set temperature in cooling operation, and FIG. 9 is a table showing an experimental result of comparing a conventional ceiling type air conditioner with a ceiling type air conditioner according to the embodiment of the present invention in terms of a time required to reach a set temperature in heating operation.

Referring to FIGS. 6 and 8, it can be seen that, in the first mixing operation performed for the first set time during the cooling operation, air discharged from the first vane group 81 and 83 flows toward walls located at both sides of the indoor space along the ceiling surface to form horizontal airflow and air discharged from the second vane group 82 and 84 flows toward the center of the floor surface of the indoor space to vertical airflow.

Accordingly, in the first mixing operation, the horizontal airflow flowing along both sidewalls of the indoor space and the vertical airflow descending toward the center of the floor surface of the indoor space and spreading in a radial direction may be mixed.

In the swing operation performed for the second set time after the first mixing operation, the first vane group 81 and 83 and the second vane group 82 and 84 reciprocally rotate at an angle between the first rotation angle a and the second rotation angle a' set in the first mixing operation.

Accordingly, in the swing operation, it is possible to promote mixing of the vertical airflow flowing in the upward-and-downward direction and the horizontal airflow flowing in the lateral direction through the first mixing operation. As a result, the mixing range of the horizontal airflow and the vertical airflow is widened.

In addition, referring to the experimental graph (FIG. 6) showing the temperature distribution of the swing operation, when a vertical line drawn from the ceiling surface in which the air conditioner 10 is installed toward the floor surface is a central axis, it can be seen that the mixing range extends from the central axis in the circumferential direction.

Accordingly, airflow may be initially concentrated to the center of the indoor space and thus airflow may be rapidly mixed in the indoor space.

In the second mixing operation performed for a third set time after the swing operation, the first rotation angle a and the second rotation angle a' of the first vane 81 and 83 and the second vane group 82 and 84, which are set in the first mixing operation, may be exchanged with each other and newly set. That is, the first vane group 81 and 83 is positioned at the second rotation angle of the first mixing operation and the second vane group 82 and 84 is positioned at the first rotation angle of the first mixing operation.

Referring to the experimental graph (FIG. 6) showing the temperature distribution of the second mixing operation, since the first vane group 81 and 83 and the second vane group 82 and 84 are located perpendicularly to each other, it can be seen that the horizontal airflow and the vertical airflow of the second mixing operation are formed in the direction perpendicular to the horizontal airflow and the vertical airflow of the first mixing operation.

That is, it can be seen that air discharged from the first vane group 81 and 83 forms vertical airflow flowing to the floor surface of the indoor space and air discharged from the second vane group 82 and 84 forms horizontal airflow flowing toward to the walls located in the forward-and-backward direction of the indoor space along the ceiling surface.

Meanwhile, despite the first mixing operation and the swing operation, a dead zone may be formed between walls located in the upward-and-downward direction of the indoor space and the central axis. The dead zone may be understood as a zone where the arrival time of airflow mixed by the first mixing operation and the swing operation is delayed or the mixed airflow is not reached.

However, referring to the experimental graph (FIG. 6) showing the temperature distribution of the second mixing operation, it can be seen that the dead zone is eliminated by the second mixing operation.

As a result, the air conditioner 10 may further facilitate mixing of the horizontal airflow and the vertical airflow in the indoor space by the first mixing operation, the swing operation and the second mixing operation and further increase a mixing range, such that the indoor temperature is rapidly lowered. That is, the air conditioner 10 may enable the indoor temperature to rapidly reach the target set temperature.

Referring to FIG. 8, it is possible to compare the cooling effect of the indoor space by the dynamic airflow of the air conditioner 10 according to the embodiment of the present invention with the cooling effect according to the rotation operation of the above-described conventional air conditioner.

Specifically, when the outdoor temperature is 35° C., an initial indoor temperature is 33° C., and the set temperature of the air conditioner is set to 26° C. with the same air volume (strong wind), it takes 13 minutes and 11 seconds to decrease the indoor temperature by 1° C. and takes 17 minutes and 37 seconds to reach the set temperature in the air conditioner 10 according to the embodiment of the present invention. In contrast, under the same condition, it takes 14 minutes and 18 seconds to decrease the indoor temperature by 1° C. and takes 35 minutes and 45 seconds to reach the set temperature in the conventional air conditioner.

That is, according to the dynamic airflow mode of the air conditioner 10 according to the embodiment of the present invention, since a time required for the indoor temperature to reach the set temperature is reduced, it is possible to rapidly give the user a pleasant feeling.

Meanwhile, referring to FIGS. 7 and 9, the dynamic airflow mode during the heating operation is similar to the dynamic airflow mode during the above-described cooling operation (FIG. 6) in terms of the flow of the horizontal airflow and the vertical airflow discharged in the first mixing operation and the second mixing operation. However, unlike the cooling operation, it will be apparent that the temperature of air discharged from the discharge vane 80 is higher than the initial indoor temperature in the heating operation.

As described above, in the heating operation performed in the relatively low indoor temperature condition, the fixing operation S160 is performed instead of the swing operation.

In the fixing operation, the first vane group 81 and 83 and the second vane group 82 and 84 are positioned at the same rotation angle. For example, in the fixing operation, the first rotation angle a and the second rotation angle a" may be set to 70°.

Accordingly, warm air discharged downward according to guide of the discharge vane 80 is continuously discharged for a second set time, such that the indoor temperature is relatively rapidly increased from the lower central portion of the indoor space.

Thereafter, as the second mixing operation is performed to mix airflow such that the dead zone is eliminated, the indoor temperature of a space where the user may feel a pleasant feeling, for example, a space from the floor surface of the indoor space to a height of 1.7 m, is relatively rapidly increased. Therefore, it is possible to shorten a time required for the indoor temperature to reach the set temperature and to improve satisfaction of the user in the heating operation.

Referring to FIG. 9, it is possible to compare the cooling effect of the indoor space by the dynamic airflow of the air conditioner 10 according to the embodiment of the present invention with the cooling effect according to the rotation operation of the above-described conventional air conditioner.

Specifically, when the outdoor temperature is 7° C., an initial indoor temperature is 12° C., and the set temperature of the air conditioner is set to 26° C. with the same air volume (strong wind), it takes 6 minutes and 50 seconds to increase the indoor temperature by 1° C. and takes 12 minutes and 36 seconds to reach the set temperature in the air conditioner 10 according to the embodiment of the present invention. In contrast, under the same condition, it takes 15 minutes and 15 seconds to increase the indoor temperature by 1° C. and takes 36 minutes and 31 seconds to reach the set temperature in the conventional air conditioner.

That is, since a time required for the indoor temperature to reach the set temperature is reduced, it is possible to rapidly give the user a pleasant feeling.

In addition, in the dynamic airflow mode during the heating operation, the vertical temperature distribution of the indoor space may be more uniform than the heating operation of the conventional air conditioner. In particular, a temperature difference between the floor surface and the ceiling surface is minimized, thereby minimizing draft.

What is claimed is:

1. A method of controlling a ceiling air conditioner including a panel located on a ceiling surface, outlets formed at positions corresponding to four sides of the panel, a first vane group that opens and closes the outlets located at two opposing sides, and a second vane group that opens and closes the outlets located at the other two opposing sides, the method comprising:

performing a dynamic airflow mode in which an indoor temperature reaches a set temperature by controlling rotational angles of the first vane group and the second vane group;

calculating a pleasant airflow index Y for determining a pleasant feeling of a user at the set temperature;

determining whether the calculated pleasant airflow index is equal to or greater than a predetermined reference value; and newly calculating the rotational angle of the first vane group or the rotational angle of the second vane group satisfying the predetermined reference value or more, when the calculated pleasant airflow index is less than the predetermined reference value, wherein the pleasant airflow index is calculated using the indoor temperature, the rotational angle of the first vane group or the second vane group, an air volume, a distance from a floor surface, and an airflow position as variables.

2. The method of claim 1, further comprising rotating the first vane group or the second vane group by the newly calculated rotational angle.

3. The method of claim 1, wherein the ceiling air conditioner further includes:

a controller configured to control the rotational angle of the first vane group or the second vane group and the air volume of a fan;

a temperature detector configured to detect the indoor temperature;

a height detector configured to detect the distance from the floor surface; and a memory configured to store the airflow position mapped to the detected distance from the floor surface.

4. The method of claim 1, further comprising calculating an airflow unpleasant feeling index indicating a degree of draft generated by an indoor vertical or horizontal temperature difference.

5. The method of claim 4, further comprising changing the air volume when the calculated airflow unpleasant feeling index is greater than a predetermined reference value.

6. The method of claim 1, wherein the first vane group is located in a vertical direction of the second vane group.

7. The method of claim 1, wherein the performing of the dynamic airflow mode includes:

performing a first mixing operation by positioning the first vane group at a first rotational angle to generate horizontal airflow and positioning the second vane group at a second rotational angle different from the first rotational angle to generate vertical airflow; and performing a swing operation of rotating the first vane group and the second vane group at an angle between the first rotational angle and the second rotational angle.

8. The method of claim 7, wherein the horizontal airflow is defined as airflow formed by discharged air flowing bidirectionally along the ceiling surface, and wherein the vertical airflow is defined as airflow formed by discharged air flowing toward the floor surface.

9. The method of claim 7, further comprising performing a second mixing operation by positioning the first vane group at the second rotational angle to generate the vertical airflow and positioning the second vane group at the first rotational angle to generate the horizontal airflow.

10. The method of claim 7, wherein the first mixing operation and the swing operation are performed for a predetermined period of time.

11. The method of claim 7, wherein the performing of the dynamic airflow mode further includes determining whether a cooling operation ora heating operation is performed.

12. The method of claim 11, wherein, upon determining that the heating operation is performed, the swing operation is replaced with a fixing operation of setting the first rotational angle and the second rotation angle to a same angle.

13. The method of claim 12, wherein, in the fixing operation, the first vane group and the second vane group form the vertical airflow.

14. The method of claim 7, wherein the first rotational angle is set to an angle greater than 20° and less than 40° .

15. The method of claim 7, wherein the second rotation rotational angle is set to an angle greater than 60° and less than 80° .

16. A method of controlling a ceiling air conditioner including a panel located on a ceiling surface, outlets formed at positions corresponding to four sides of the panel, a first vane group that opens and closes the outlets located at two opposing sides, and a second vane group that opens and closes the outlets located at the other two opposing sides, the method comprising:

performing a dynamic airflow mode in which an indoor temperature reaches a set temperature by controlling rotational angles of the first vane group and the second vane group;

calculating a pleasant airflow index Y for determining a pleasant feeling of a user at the set temperature, wherein the pleasant airflow index is calculated using the indoor temperature, the rotational angle of the first vane group or the second vane group, an air volume, a distance from a floor surface, and an airflow position as variables;

calculating an airflow unpleasant feeling index indicating a degree of draft generated by an indoor vertical or horizontal temperature difference; and changing the air volume when the calculated airflow unpleasant feeling index is greater than a predetermined reference value.

* * * * *